US010213837B2

(12) United States Patent
Kondoh

(10) Patent No.: US 10,213,837 B2
(45) Date of Patent: Feb. 26, 2019

(54) TITANIUM POWDER CONTAINING SOLID-SOLUTED NITROGEN, TITANIUM MATERIAL, AND METHOD FOR PRODUCING TITANIUM POWDER CONTAINING SOLID-SOLUTED NITROGEN

(71) Applicants: HI-LEX CORPORATION, Hyogo (JP); Katsuyoshi Kondoh, Osaka (JP)

(72) Inventor: Katsuyoshi Kondoh, Osaka (JP)

(73) Assignees: HI-LEX CORPORATION, Hyogo (JP); KATSUYOSHI KONDOH, Osaka (JP)

( * ) Notice: Subject to any disclaimer, the term of this patent is extended or adjusted under 35 U.S.C. 154(b) by 163 days.

(21) Appl. No.: 15/113,637

(22) PCT Filed: Dec. 26, 2014

(86) PCT No.: PCT/JP2014/084530
§ 371 (c)(1),
(2) Date: Jul. 22, 2016

(87) PCT Pub. No.: WO2015/111361
PCT Pub. Date: Jul. 30, 2015

(65) Prior Publication Data

US 2017/0008087 A1 Jan. 12, 2017

(30) Foreign Application Priority Data

Jan. 24, 2014 (JP) ..... 2014-011362

(51) Int. Cl.

| | |
|---|---|
| ***B23F 1/00*** | (2006.01) |
| ***B22F 3/20*** | (2006.01) |
| ***C22C 14/00*** | (2006.01) |
| ***B22F 9/16*** | (2006.01) |
| ***B22F 1/00*** | (2006.01) |
| ***C22C 1/04*** | (2006.01) |
| ***C23C 8/24*** | (2006.01) |

(52) U.S. Cl.
CPC ..... *B22F 9/16* (2013.01); *B22F 1/0003* (2013.01); *B22F 1/0088* (2013.01); *B22F 3/20* (2013.01); *C22C 1/0458* (2013.01); *C22C 14/00* (2013.01); *C23C 8/24* (2013.01); *B22F 2201/02* (2013.01); *B22F 2301/205* (2013.01); *B22F 2998/10* (2013.01)

(58) Field of Classification Search
CPC ..... C23C 8/24; C22C 1/0458; C22C 14/00; B22F 2201/02; B22F 1/0003; B22F 1/0088; B22F 3/20; B22F 2301/205
See application file for complete search history.

(56) References Cited

U.S. PATENT DOCUMENTS

| | | | | |
|---|---|---|---|---|
| 5,152,960 | A * | 10/1992 | Yuki | C22C 14/00 148/407 |
| 2012/0149183 | A1* | 6/2012 | Kim | H01L 27/0688 438/570 |
| 2014/0212319 | A1* | 7/2014 | Shiraishi | C22C 14/00 419/13 |

FOREIGN PATENT DOCUMENTS

| | | | |
|---|---|---|---|
| EP | 0 457 340 | A1 | 11/1991 |
| JP | 61-110734 | * | 5/1986 |
| JP | 63-60296 | * | 3/1988 |
| JP | 4-218634 | * | 8/1992 |
| JP | 2009-280842 | A | 12/2009 |
| JP | 4408184 | B2 | 2/2010 |
| JP | 2012-41609 | A | 3/2012 |
| JP | 2012-251234 | A | 12/2012 |
| JP | 2012-255192 | A | 12/2012 |
| WO | WO 2012/169305 | * | 12/2012 |

OTHER PUBLICATIONS

International Search Report from corresponding International Application No. PCT/JP2014/084530.
Ando, Tomohiro, et al., "Effect of Nitrogen on Tensile Deformation Behavior and Development of Deformation Structure in Titanium," Journal of the Japan Institute of Metals and Materials, vol. 72, No. 12 (2008), pp. 949-954.
Liu, et al., "Surface hardening of Ti alloy by gas-phase nitridation: kinetic control of the nitrogen surface activity," Metallurgical and Materials Transactions, vol. 36A, Sep. 2005, pp. 1-6.

* cited by examiner

*Primary Examiner* — C Melissa Koslow
(74) *Attorney, Agent, or Firm* — Hauptman Ham, LLP

(57) ABSTRACT

A method for producing titanium powder containing a solid-soluted nitorogen comprises the step of heating titanium powder comprised of titanium particles in a nitrogen-containing atmosphere to dissolve nitrogen atoms and form a solid solution of nitrogen atom in a matrix of the titanium particle.

2 Claims, 4 Drawing Sheets

TITANIUM POWDER CONTAINING SOLID-SOLUTED NITROGEN, TITANIUM MATERIAL, AND METHOD FOR PRODUCING TITANIUM POWDER CONTAINING SOLID-SOLUTED NITROGEN

TECHNICAL FIELD

The present invention relates to titanium powder and titanium materials, and more particularly to titanium powder strengthened by a solid solution of nitrogen in titanium, titanium materials, and methods for producing such a strengthened titanium powder and a titanium material.

BACKGROUND ART

Titanium is a lightweight material whose specific gravity is as low as about half that of steel and which is characterized by its high corrosion resistance and high strength. Titanium is therefore used for parts of aircrafts, railway vehicles, two-wheeled vehicles, automobiles, etc. for which reduction in weight is greatly desired, home appliances, members for construction, etc. Titanium is also used as a material for medical use because of its high corrosion resistance.

However, applications of titanium are limited due to its high material cost, as compared to iron and steel materials and aluminum alloys. In particular, titanium alloys have tensile strength as high as more than 1,000 MPa, but do not have enough ductility (elongation to failure). Moreover, titanium alloys have poor plastic workability at normal temperature or in a low temperature range. Pure titanium has elongation to failure as high as more than 25% at normal temperature and has excellent plastic workability in a low temperature range. However, pure titanium has tensile strength as low as about 400 to 600 MPa.

Various studies have been carried out in response to a very strong need for titanium having both high strength and high ductility and for reduction in material cost of titanium. In particular, many techniques of strengthening titanium by using relatively inexpensive elements such as oxygen and nitrogen rather than expensive elements such as vanadium, scandium, and niobium have been studied as related art in order to achieve cost reduction.

For example, Journal of the Japan Institute of Metals and Materials, Vol. 72, No. 12 (2008), pp. 949-954 (Non-Patent Literature 1), entitled "Effect of Nitrogen on Tensile Deformation Behavior and Development of Deformation Structure in Titanium," describes the use of nitrogen as an alloy element for titanium alloys. Specifically, Non-Patent Literature 1 describes that titanium sponge and TiN powder are weighed to predetermined compositions and are arc-melted to produce Ti—N alloys with various nitrogen concentrations. In this case, both high strength and high ductility can be achieved if a homogenous solid solution of nitrogen atoms in a Ti matrix is formed.

Another method is a technique of adding TiN particles to molten Ti to form a solid solution of nitrogen atoms in a Ti matrix when the mixture of TiN particles and molten Ti solidifies. In this case as well, both high strength and high ductility can be achieved if a homogenous solid solution of nitrogen atoms in the Ti matrix is formed.

CITATION LIST

Non-Patent Literature

NPTL 1: Journal of the Japan Institute of Metals and Materials, Vol. 72, No. 12 (2008), pp. 949-954

SUMMARY OF INVENTION

Technical Problem

In conventional melting methods (in particular, a method of adding TiN particles to molten Ti), nitrogen atoms are significantly diffused and therefore are concentrated in the upper part of the molten Ti. Accordingly, it is difficult to uniformly disperse nitrogen in a large ingot, which significantly reduces ductility.

It is an object of the present invention to provide a method for producing titanium powder containing a solid-soluted nitrogen, in which nitrogen atoms can be uniformly diffused in a matrix of Ti particles to form a solid solution.

It is another object of the present invention to provide titanium powder and a titanium material which have both high strength and high ductility by uniformly diffusing nitrogen atoms in a matrix of Ti powder particles to form a solid solution.

Solution to Problem

A method for producing titanium powder containing a solid-soluted nitrogen according to the present invention comprises the step of heating the titanium powder comprised of titanium particles in a nitrogen-containing atmosphere to dissolve nitrogen atoms and form a solid solution of the nitrogen atom in a matrix of the titanium particles. A heating temperature for forming the solid solution of the nitrogen atom in the matrix of the titanium particles is preferably 400° C. or more and 800° C. or less.

In the titanium powder containing the solid-soluted nitrogen produced by the above method, the titanium particle preferably has a nitrogen content of 0.1 mass % or more and 0.65 mass % or less. For reference, the nitrogen contents of four types of pure titanium specified by Japanese Industrial Standards (JIS) are as follows.

JIS H 4600 Type 1: 0.03 mass % or less
JIS H 4600 Type 2: 0.03 mass % or less
JIS H 4600 Type 3: 0.05 mass % or less
JIS H 4600 Type 4: 0.05 mass % or less A titanium material is a material produced by forming the titanium powder containing the solid-soluted nitrogen into a predetermined shape. In one embodiment, the titanium material is an extruded material of pure Ti powder, the extruded material has a nitrogen content of 0.1 mass % to 0.65 mass %, and the extruded material has elongation to failure of 10% or more.

Examples of a method for compacting the titanium powder containing the solid-soluted nitrogen to produce the titanium material include powder compaction and sintering, hot extrusion, hot rolling, thermal spraying, metal injection molding, powder additive manufacturing, etc.

Functions and effects or technical significance of the above characteristic configuration will be described in the following sections.

DESCRIPTION OF EMBODIMENTS

Figure 1:
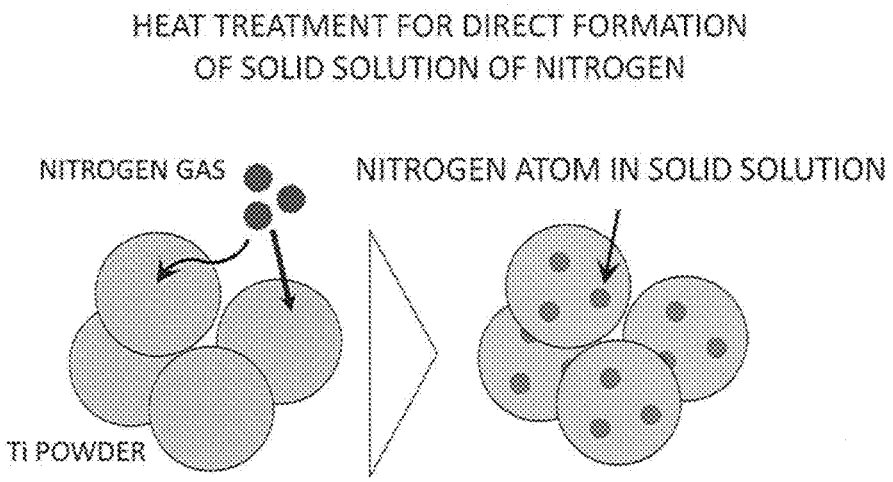
FIG. 1 is a diagram schematically showing characteristics of the present invention.

FIG. 1 is a diagram schematically showing characteristics of the present invention. First, the outline of the present invention will be described with reference to FIG. 1, and more detailed data etc. will then be described.

[Preparation of Titanium Powder]

A titanium powder made of a multiplicity of titanium particles is prepared. As used herein, the "titanium particles" may be either pure titanium particles or titanium alloy particles.

[Heat Treatment for Solid Solution Formation]

The titanium powder comprised of titanium particles is heated in a nitrogen-containing atmosphere and retained therein to uniformly diffuse nitrogen atoms in a matrix of the titanium particles to form a solid solution, so that an intended solid solution of nitrogen in the titanium powder is eventually produced.

For example, heating conditions are as follows.

Heating atmosphere: 100 vol % of $N_2$ gas

Gas flow rate: 5 L/min

Heating temperature: 400 to 600° C.

Retention time: 1 to 2 hours

By the above heat treatment for solid solution formation, the nitrogen atoms are uniformly diffused in the matrix of the titanium powder particles to form a solid solution. Either a tubular heating furnace (non-rotary) or a rotary kiln furnace may be used because a sintering phenomenon between the titanium particles does not proceed in the above heating process.

For example, the titanium powder containing the solid-soluted nitrogen thus produced is compacted by powder compaction and sintering, hot extrusion, hot rolling, thermal spraying, metal injection molding, powder additive manufacturing, etc.

[Examination with Differential Thermogravimetric Analyzer (TG-DTA)]

Figure 2:
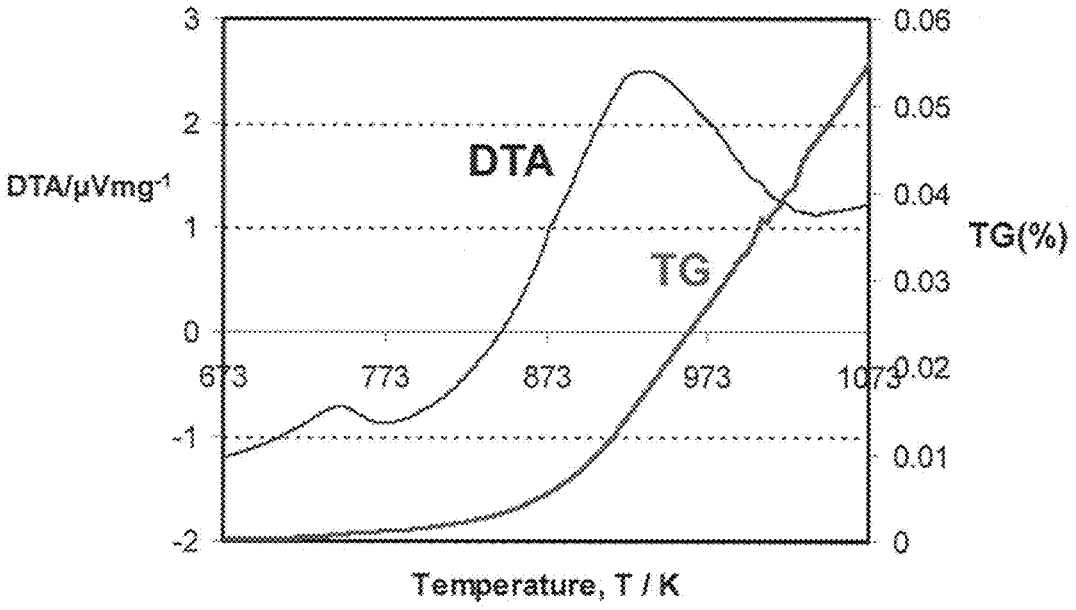
FIG. 2 is a diagram showing data measured with a differential thermogravimetric analyzer.

Pure Ti raw material powder was placed into a furnace. With nitrogen gas being introduced into the furnace at a flow rate of 150 mL/min, the pure Ti raw material powder was heated from normal temperature to 800° C. (1,073 K). The weight started increasing at a temperature near 400° C. (673 K), and the weight subsequently significantly increased with an increase in temperature. The result is shown in FIG. 2. In FIG. 2, TG (Thermogravimetry) represents a change in weight and DTA (Differential Thermal Analysis) represents exothermic/endothermal behavior.

[Measurement of Nitrogen and Oxygen Contents]

With nitrogen gas being introduced into a tubular heating furnace at a flow rate of 5 L/min, pure Ti powder was heated at 400° C. (673 K), 500° C. (773 K), and 600° C. (873 K) for one hour. Thereafter, the nitrogen content and the oxygen content in the resultant Ti powder were measured. The result is shown in Table 1.

TABLE 1

| Specimens | Nitrogen Content (mass %) | Oxygen Content (mass %) |
|---|---|---|
| Pure Ti Raw Material Powder | 0.018 | 0.270 |
| 673K for 1 hr | 0.041 | 0.276 |
| 773K for 1 hr | 0.129 | 0.275 |
| 873K for 1 hr | 0.292 | 0.290 |

Table 1 shows that the nitrogen content increased with an increase in heating temperature. However, the oxygen content changed very little. This shows that oxidation of the Ti powder in the heating process was restrained.

The result of Table 1 closely matches the result obtained by the differential thermogravimetric analyzer (TG-DTA). It is therefore desirable that the heating temperature be 400° C. (673 K) or more in order to form a solid solution of nitrogen atoms in a Ti matrix. However, the heating temperatures higher than 800° C. cause partial sintering between Ti particles. It is therefore desirable that the heating temperature be 800° C. or less.

[Examination with Diffraction Peaks]

Figure 3:
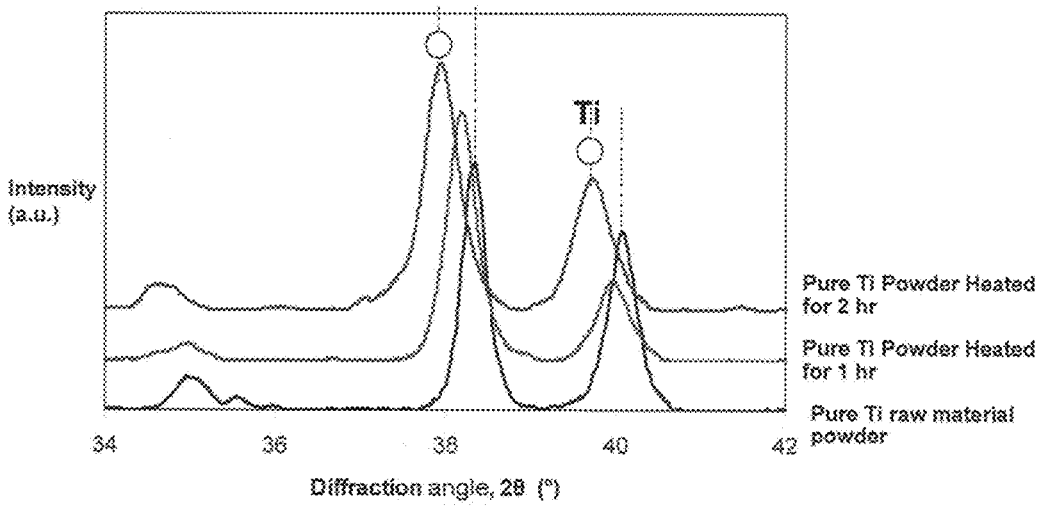
FIG. 3 is a diagram showing diffraction peak shifts of Ti caused by heat treatment for formation of a solid solution of nitrogen.

FIG. 3 shows diffraction peak shifts of Ti caused by heat treatment for formation of a solid solution of nitrogen. Specifically, with nitrogen gas being introduced into a tubular heating furnace at a flow rate of 5 L/min, pure Ti powder was heated at 600° C. (873 K) for one hour and two hours. Thereafter, X-ray diffraction (XRD) analysis of the resultant Ti powder was conducted.

As can be seen from FIG. 3, diffraction peaks of Ti are shifted to lower angles if pure titanium raw material powder is subjected to the heat treatment for formation of a solid solution of nitrogen. These peak shifts show that a solid solution of nitrogen atoms in a Ti matrix was formed.

The oxygen and nitrogen contents in the above specimens were measured. The result is shown in Table 2.

TABLE 2

| | Nitrogen Content (mass %) | Oxygen Content (mass %) |
|---|---|---|
| Raw Material Powder | 0.018 | 0.260 |
| Powder Heated for 1 hr | 0.290 | 0.263 |
| Powder Heated for 2 hr | 0.479 | 0.262 |

The result of Table 2 shows that the oxygen content changed very little, and the nitrogen content increased with an increase in heating time.

[Examination with Crystal Orientation Analysis (SEM-EBSD)]

Each of the Ti powders was formed and compacted by spark plasma sintering. The resultant sintered body was hot-extruded to produce an extruded material with a diameter φ of 7 mm.

In the spark plasma sintering, each Ti powder was heated in a vacuum atmosphere at 800° C. for 30 min, and a pressure of 30 MPa was applied to each Ti powder in the heating process.

In the hot extrusion, the sintered body was heated in an argon gas atmosphere at 100° C. for 5 min. The heated sintered body was immediately extruded at an extrusion ratio of 37 to produce an extruded material with a diameter φ of 7 mm.

Figure 4:
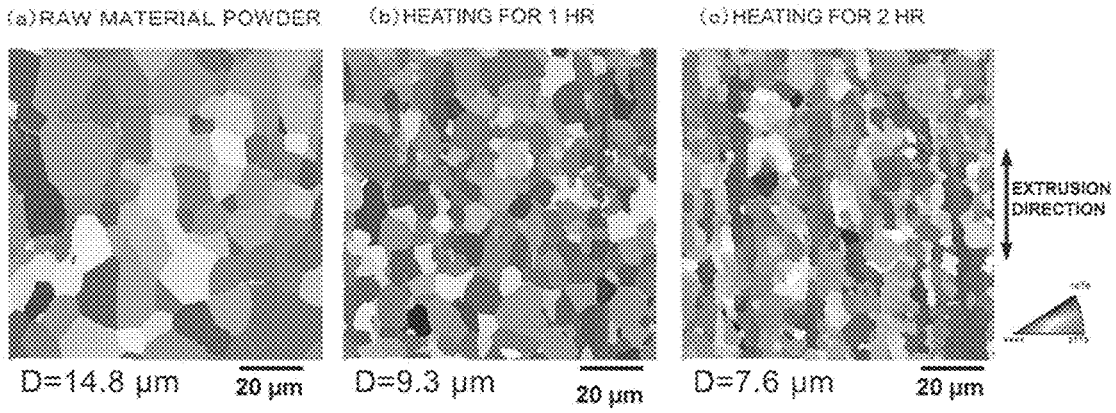
FIG. 4 shows the measurement result of crystal orientation analysis (SEM-EBSD).

The result of grain size measurement by crystal orientation analysis (SEM-EBSD) shows that the grain size decreased with an increase in nitrogen content, namely crystal grains became smaller as the nitrogen content increased. The result is shown in FIG. 4. This is because a part of nitrogen atoms forming a solid solution was diffused and concentrated at Ti grain boundaries and coarsening of the crystal grains was restrained by the solute drag effect.

[Measurement of Strength]

Strength was measured for the extruded materials produced from the following Ti powders. "Ti powder heated for 1 hr," namely Ti powder subjected to the heat treatment for formation of a solid solution of nitrogen for 1 hour and having a nitrogen content of 0.290 mass %, "Ti powder heated for 2 hrs," namely Ti powder subjected to the heat treatment for formation of a solid solution of nitrogen for 2 hours and having a nitrogen content of 0.479 mass %, and "Ti raw material powder" (nitrogen content: 0.018 mass %) that was not subjected to the heat treatment for formation of a solid solution of nitrogen. The result is shown in FIG. 5 and Table 3.

TABLE 3

| Specimen | 0.2% YS, σy/MPa | UTS, σ/MPa | Elongation, ε (%) | Hardness Hv |
|---|---|---|---|---|
| Ti raw material powder | 479 ± 8.1 | 653 ± 6.6 | 28 ± 1.7 | 264 ± 26.3 |
| Ti Powder Heated for 1 hr | 903 ± 17.4 | 1008 ± 6.1 | 24 ± 1.5 | 479 ± 34.2 |
| Ti Powder Heated for 2 hr | 1045 ± 13.6 | 1146 ± 7.1 | 11 ± 2.3 | 539 ± 45.5 |

Figure 5:
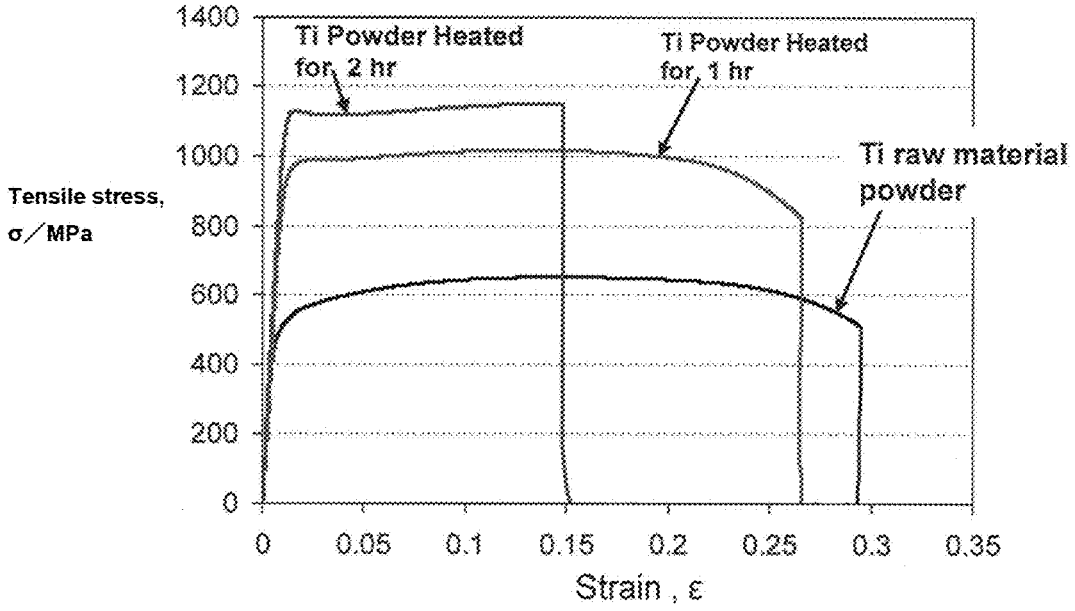
FIG. 5 is a diagram showing the relationship between stress and strain.

As can be seen from FIG. 5 and Table 3, the Ti powders subjected to the heat treatment for formation of a solid solution of nitrogen exhibited increased strength due to formation of a solid solution of nitrogen atoms. The Ti powders subjected to the heat treatment for formation of a solid solution of nitrogen also exhibited reduced elongation, but the elongations of both Ti powders are higher than 10%. These Ti powders therefore have high ductility as a Ti material.

An extruded material produced from "Ti powder heated for 3 hrs" (nitrogen content: 0.668 mass %, oxygen content: 0.265 mass %), namely Ti powder subjected to the heat treatment for formation of a solid solution of nitrogen for 3 hours, exhibited increased tensile strength (UTS) of 1,264 MPa and increased 0.2% yield strength (YS) of 1,204 MPa, but exhibited significantly reduced elongation of 1.2%. A preferred upper limit of the nitrogen content is therefore 0.65 mass %. A preferred lower limit of the nitrogen content is 0.1 mass % in view of improvement in strength.

[Relationship between Heat Treatment Time and Nitrogen and Oxygen Contents]

Pure Ti powder (average grain size: 28 μn, purity: >95%) was used as a starting material. With nitrogen gas (gas flow rate: 3 L/min) being introduced into a tubular furnace, Ti raw material powder was placed into the tubular furnace, and the heat treatment for formation of a solid solution of nitrogen was performed at 600° C. for 10 to 180 minutes. The relationship between the heat treatment time and the nitrogen and oxygen contents in each of the resultant Ti powders was measured. The result is shown in FIG. 6 and Table 4.

TABLE 4

| Heat Treatment Time (min) | 0 | 10 | 30 | 60 | 120 | 180 |
|---|---|---|---|---|---|---|
| Nitrogen Content (mass %) | 0.023 | 0.225 | 0.350 | 0.518 | 0.742 | 0.896 |
| Oxygen Content (mass %) | 0.217 | 0.252 | 0.246 | 0.225 | 0.224 | 0.229 |

Figure 6:
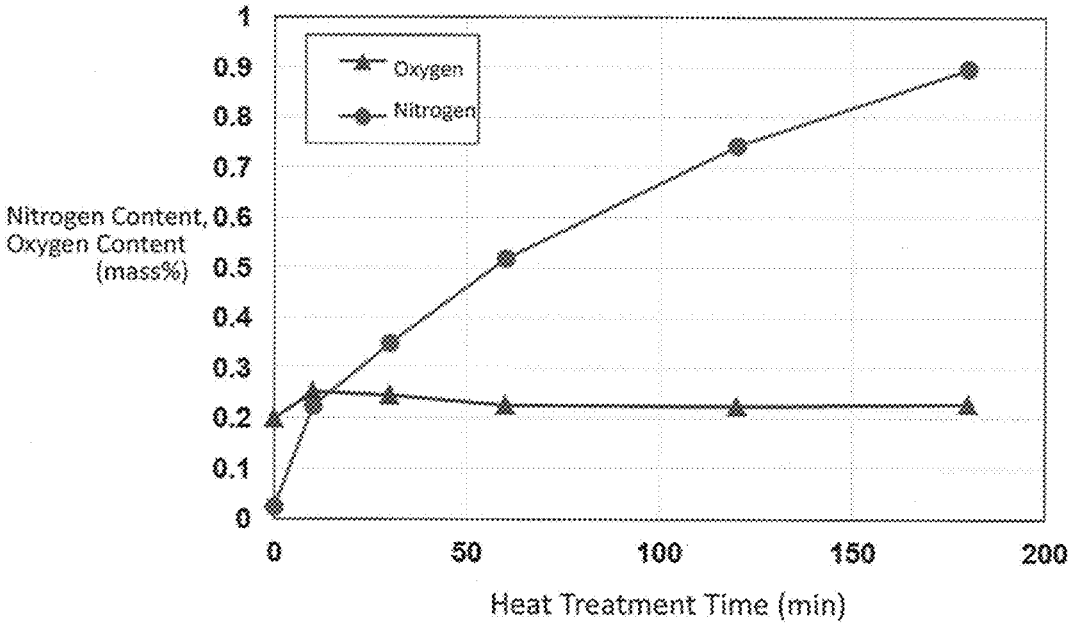
FIG. 6 is a diagram showing the relationship between heat treatment time and nitrogen and oxygen contents.

As can be seen from FIG. 6 and Table 4, the nitrogen content increases substantially linearly with the heat treatment time. This shows that the nitrogen content in Ti powder can be controlled by the heat treatment time. On the other hand, the oxygen content does not increase with the heat treatment time and is substantially constant. This shows that oxidation did not occur in the heat treatment process. Ti powder having an intended nitrogen content can thus be produced by this production method.

[Relationship between Nitrogen Content and Micro Vickers Hardness Hv]

The nitrogen-containing Ti powders shown in Table 4 were heated and pressed with a spark plasma sintering (SPS) system to produce sintered bodies (diameter: 40 mm, thickness: 10 mm).

Spark plasma sintering was performed under the following conditions.

Temperature: 1,000° C.

Pressing force: 30 MPa

Sintering time: 30 minutes

Degree of vacuum: 6 Pa

Micro Vickers hardness (load: 50 g) of these sintered bodies was measured. The result is shown in FIG. 7 and Table 5.

TABLE 5

| Heating Time | Nitrogen Content | Hardness Hv (N = 20) | | |
|---|---|---|---|---|
| (min) | (mass %) | Average | Maximum | Minimum |
| 0 | 0.023 | 214.6 | 259 | 188 |
| 10 | 0.225 | 305.4 | 389 | 276 |
| 30 | 0.350 | 324.3 | 352 | 283 |
| 60 | 0.518 | 363.6 | 397 | 340 |
| 120 | 0.742 | 390.8 | 459 | 324 |
| 180 | 0.896 | 432.4 | 543 | 346 |

Figure 7:
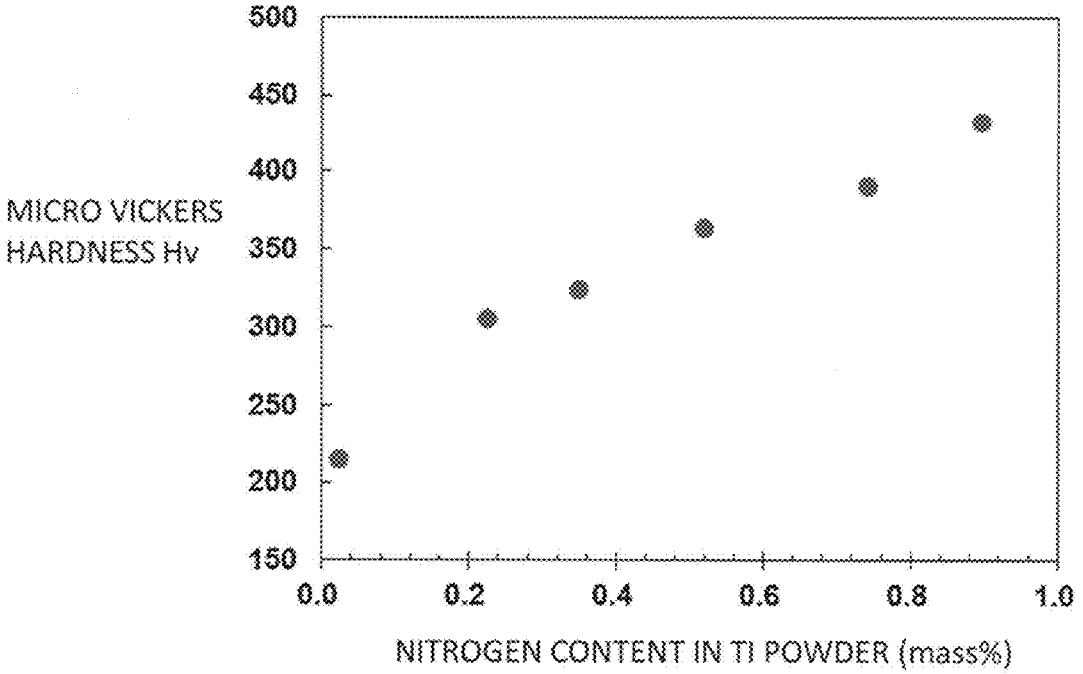
FIG. 7 is a diagram showing the relationship between nitrogen content and micro Vickers hardness Hv.

As can be seen from FIG. 7 and Table 5, Vickers hardness increased substantially linearly with an increase in nitrogen content in the Ti powder. This shows that hardness of the sintered body was significantly increased by formation of a solid solution of nitrogen atoms in the Ti powder.

[Relationship between Proportion of Oxygen Gas Flow Rate and Nitrogen and Oxygen Contents]

Figure 8:
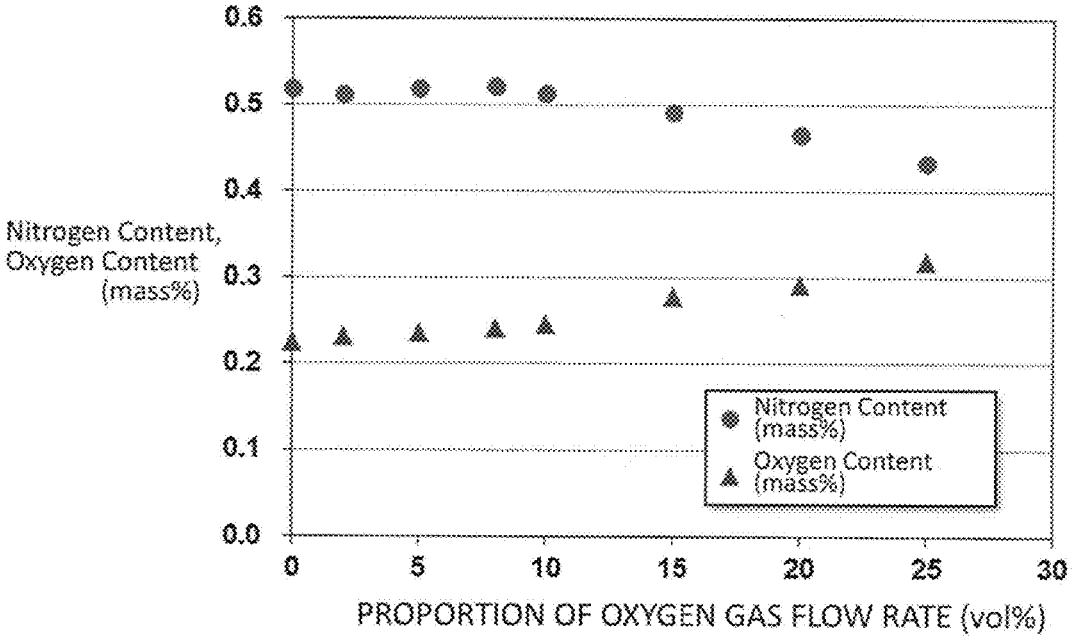
FIG. 8 is a diagram showing the relationship between proportion of the oxygen gas flow rate and nitrogen and oxygen contents.

Pure Ti powder (average grain size: 28 μn, purity: >95%) was used as a starting material. With nitrogen gas and oxygen gas being introduced at various mixing ratios into a tubular furnace, Ti raw material powder was placed into the tubular furnace and heated at 600° C. for 60 minutes. The nitrogen content and the oxygen content in each of the resultant Ti powders were measured. The result is shown in FIG. 8 and Table 6.

TABLE 6

| | | | | | | | | |
|---|---|---|---|---|---|---|---|---|
| Nitrogen Gas Flow Rate (L/min) | 3 | 2.94 | 2.85 | 2.76 | 2.7 | 2.55 | 2.4 | 2.25 |

TABLE 6-continued

| | | | | | | | | |
|---|---|---|---|---|---|---|---|---|
| Oxygen Gas Flow Rate (L/min) | 0 | 0.06 | 0.15 | 0.24 | 0.3 | 0.45 | 0.6 | 0.75 |
| Proportion of Oxygen Gas Flow Rate (%) | 0 | 2 | 5 | 8 | 10 | 15 | 20 | 25 |
| Nitrogen Content (mass %) | 0.518 | 0.512 | 0.519 | 0.522 | 0.514 | 0.491 | 0.465 | 0.433 |
| Oxygen Content (mass %) | 0.225 | 0.232 | 0.236 | 0.242 | 0.246 | 0.278 | 0.292 | 0.319 |

As can be seen from FIG. 8 and Table 6, when the proportion of oxygen gas is 10 vol % or less, the oxygen content does not significantly increase, which shows that only nitrogen atoms are diffused in a Ti matrix to form a solid solution. However, when the proportion of oxygen gas is higher than 15 vol %, the oxygen content also increases, which shows that both nitrogen atoms and oxygen atoms can be diffused in a Ti matrix to form a solid solution. According to this production method, Ti powder in which not only nitrogen atoms but also oxygen atoms are diffused to form a solid solution can be produced by adjusting the mixing ratio of oxygen gas and nitrogen gas in a heat treatment atmosphere.

INDUSTRIAL APPLICABILITY

The present invention can be advantageously used to produce titanium powder strengthened by a solid solution of nitrogen in titanium and maintaining appropriate ductility by uniformly diffusing nitrogen in a matrix to form a solid solution, and a titanium material.

The invention claimed is:

1. A method for producing titanium powder containing a solid-soluted nitrogen, the method comprising:

heating titanium powder comprising titanium particles in a nitrogen-containing atmosphere to dissolve nitrogen atoms and form a solid solution of nitrogen atoms in a matrix of the titanium particles, wherein a heating temperature for forming the solid solution of the nitrogen atoms in the matrix of the titanium particles is 400° C. or more and 600° C. or less, and the heating causes the titanium particles to have a nitrogen content of 0.1 mass % or more and 0.65 mass % or less.

2. The method for producing the titanium powder containing the solid-soluted nitrogen according to claim 1, wherein the heating of the titanium powder in the nitrogen-containing atmosphere occurs for a period of time corresponding to the heating temperature to cause the titanium particles in the matrix of titanium particles to have the nitrogen content of 0.1 mass % or more and 0.65 mass % or less.

* * * * *